US010366616B2

(12) United States Patent
Kube

(10) Patent No.: US 10,366,616 B2
(45) Date of Patent: Jul. 30, 2019

(54) SYSTEM AND METHOD OF COLLISION AVOIDANCE IN UNMANNED AERIAL VEHICLES

(71) Applicant: Botlink, LLC, Fargo, ND (US)

(72) Inventor: Alexander J. Kube, Fargo, ND (US)

(73) Assignee: Botlink, LLC, Fargo, ND (US)

( * ) Notice: Subject to any disclaimer, the term of this patent is extended or adjusted under 35 U.S.C. 154(b) by 219 days.

(21) Appl. No.: 14/991,115

(22) Filed: Jan. 8, 2016

(65) Prior Publication Data

US 2016/0203723 A1 Jul. 14, 2016

Related U.S. Application Data

(60) Provisional application No. 62/108,745, filed on Jan. 28, 2015, provisional application No. 62/101,859, filed on Jan. 9, 2015.

(51) Int. Cl.
*G08G 5/00* (2006.01)
*G08G 5/04* (2006.01)

(52) U.S. Cl.
CPC ..... *G08G 5/045* (2013.01); *G08G 5/0013* (2013.01); *G08G 5/0026* (2013.01); *G08G 5/0069* (2013.01); *G08G 5/0082* (2013.01)

(58) Field of Classification Search
None
See application file for complete search history.

(56) References Cited

U.S. PATENT DOCUMENTS

| | | | | |
|---|---|---|---|---|
| 5,890,441 | A | 4/1999 | Swinson | |
| 7,228,232 | B2 * | 6/2007 | Bodin | G01C 23/00 701/301 |
| 8,989,053 | B1 | 3/2015 | Skaaksrud | |
| 9,257,048 | B1 | 2/2016 | Offer | |
| 9,412,278 | B1 * | 8/2016 | Gong | G06F 16/29 |
| 9,501,060 | B1 * | 11/2016 | Zhang | B64C 39/024 |
| 9,508,263 | B1 * | 11/2016 | Teng | B64C 39/024 |
| 9,527,587 | B2 * | 12/2016 | Levien | B64C 39/024 |
| 9,551,552 | B2 * | 1/2017 | Kolanek | F41G 7/007 |
| 9,626,874 | B1 * | 4/2017 | Gupta | G08G 5/0069 |
| 2009/0027253 | A1 * | 1/2009 | van Tooren | G01S 13/9303 342/29 |
| 2009/0210109 | A1 * | 8/2009 | Ravenscroft | G01C 21/005 701/26 |
| 2010/0042269 | A1 * | 2/2010 | Kokkeby | G01S 3/7864 701/3 |
| 2010/0131121 | A1 * | 5/2010 | Gerlock | G08G 5/0013 701/2 |
| 2010/0163621 | A1 * | 7/2010 | Ben-Asher | G05D 1/0088 235/412 |

(Continued)

*Primary Examiner* — Jonathan M Dager
(74) *Attorney, Agent, or Firm* — Billion & Armitage

(57) ABSTRACT

A collision avoidance system includes an unmanned aerial vehicle (UAV), a UAV controller, and a safety data aggregator. The UAV includes a positional sensor, and is coupled to communicate positional data to the UAV controller, and receive commands from the UAV controller. The safety data aggregator is coupled to communicate with the UAV controller, wherein the safety data aggregator collects positional data from one or more UAV controllers, stores collected positional data in a safety data buffer, and extracts spatially relevant positional data in response to a request from the UAV controller.

22 Claims, 4 Drawing Sheets

(56) References Cited

U.S. PATENT DOCUMENTS

2010/0204867 A1* 8/2010 Longstaff ..... G01S 13/003 701/26
2010/0286859 A1* 11/2010 Feigh ..... G05D 1/0044 701/25
2010/0315281 A1* 12/2010 Askelson ..... G01S 7/003 342/30
2010/0332136 A1* 12/2010 Duggan ..... G08G 5/0069 701/301
2011/0035149 A1* 2/2011 McAndrew ..... G05D 1/0038 701/466
2012/0022719 A1* 1/2012 Matos ..... B64C 39/024 701/2
2012/0092208 A1* 4/2012 LeMire ..... G01S 13/87 342/29
2012/0143482 A1* 6/2012 Goossen ..... G08G 5/0034 701/120
2012/0158219 A1* 6/2012 Durling ..... G01S 5/0072 701/4
2012/0158280 A1* 6/2012 Ravenscroft ..... G01C 21/005 701/400
2012/0209457 A1* 8/2012 Bushnell ..... G01C 21/00 701/13
2012/0296497 A1* 11/2012 Lee ..... G05D 1/0202 701/3
2014/0142787 A1* 5/2014 Tillotson ..... G05D 1/101 701/3
2014/0156109 A1* 6/2014 Estkowski ..... G05D 1/101 701/2
2014/0249738 A1* 9/2014 Euteneuer ..... G01S 13/9303 701/301
2014/0303884 A1* 10/2014 Levien ..... G08G 5/04 701/301
2014/0306799 A1 10/2014 Ricci
2015/0246727 A1 9/2015 Masticola
2015/0254988 A1* 9/2015 Wang ..... G05D 1/0214 701/3
2015/0325064 A1* 11/2015 Downey ..... G08G 5/006 701/29.3
2015/0336668 A1* 11/2015 Pasko ..... B64C 39/024 701/2
2015/0350914 A1 12/2015 Baxley
2015/0370251 A1* 12/2015 Siegel ..... G05D 1/0027 701/2
2015/0379874 A1* 12/2015 Ubhi ..... G01S 5/0027 701/3
2016/0068267 A1* 3/2016 Liu ..... B64C 39/024 701/11
2016/0070265 A1 3/2016 Liu
2016/0117853 A1 4/2016 Zhong
2016/0225264 A1* 8/2016 Taveira ..... B64C 39/024
2016/0240087 A1* 8/2016 Kube ..... G08G 5/006
2016/0328983 A1* 11/2016 Hutchinson ..... G08G 5/045
2017/0069214 A1* 3/2017 Dupray ..... G08G 5/0021
2017/0169713 A1* 6/2017 Gong ..... G06F 16/29
2017/0263132 A1* 9/2017 Butler ..... G08G 5/0039
2017/0263133 A1* 9/2017 Blomberg ..... G08G 5/0039
2017/0263134 A1* 9/2017 Blomberg ..... G08G 5/0039
2017/0278409 A1* 9/2017 Johnson ..... G08G 5/0069
2017/0278410 A1* 9/2017 Byers ..... B64C 39/024
2017/0358223 A1* 12/2017 Priest ..... G08G 5/0069

* cited by examiner

SYSTEM AND METHOD OF COLLISION AVOIDANCE IN UNMANNED AERIAL VEHICLES

TECHNICAL FIELD

The present disclosure is related generally to collision avoidance systems, and more specifically, to systems and methods for collision avoidance in unmanned aerial vehicles.

BACKGROUND

Unmanned aerial vehicles (UAVs), once utilized solely in military applications, are becoming more ubiquitous in everyday life. Although a variety of names have been used to describe these systems and devices, such as remotely piloted aircraft, unmanned aircraft, or drone, the common characteristic between each is that no pilot is present within the aircraft. Rather, they are controlled either autonomously by onboard computers or by the remote control of a pilot on the ground or in another vehicle.

However, the proliferation of UAVs has led to safety concerns. Traditional piloted aircraft—at least in high traffic areas—communicate with and may be controlled by FAA air traffic controllers. UAVs, in contrast, are not in communication with or controlled by FAA air traffic controllers. This has led to safety concerns regarding the possibility of UAVs interfering with the flight paths of piloted aircraft, as well as UAVs interfering or colliding with one another.

A proposed solution to this problem requires each UAV to include radar or other onboard collision-avoidance sensors to detect and avoid nearby aircraft. However, the addition of sensors and collision avoidance equipment on-board each UAV adds considerable cost, thereby obviating one of the reasons UAVs are attractive in many applications.

It would therefore be beneficial to develop a system that provides collision avoidance for UAVs without requiring the addition of on-board collision avoidance sensors.

DETAILED DESCRIPTION

Figure 1:
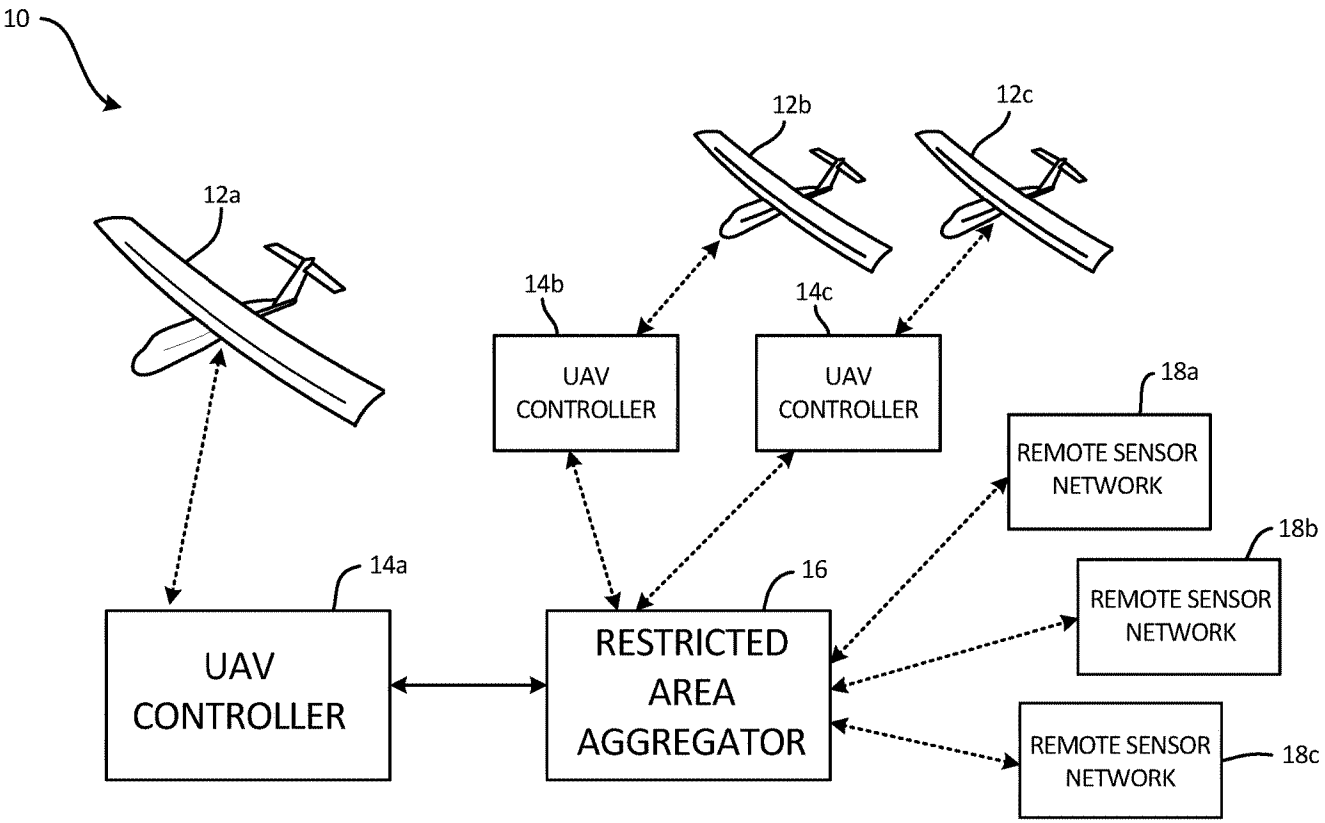
FIG. 1 is a schematic diagram illustrating a collision avoidance system according to an embodiment of the present invention.

FIG. 1 is a schematic diagram illustrating collision avoidance system 10 according to an embodiment of the present invention. In the embodiment shown in FIG. 1, collision avoidance system 10 includes one or more unmanned aerial vehicles (UAVs) 12*a*, 12*b*, and 12*c* (generally, UAVs 12), one or more UAV controllers 14*a*, 14*b*, and 14*c* (generally, UAV controller 14), safety data aggregator 16, and one or more third party remote sensing networks 18*a*, 18*b*, 18*c*. For purposes of this discussion, collision avoidance system 10 will be described with respect to interactions between UAV 12*a* and UAV controller 14*a*, although these interactions would be approximately the same between any respective pair of UAV and UAV controller.

Figure 2:
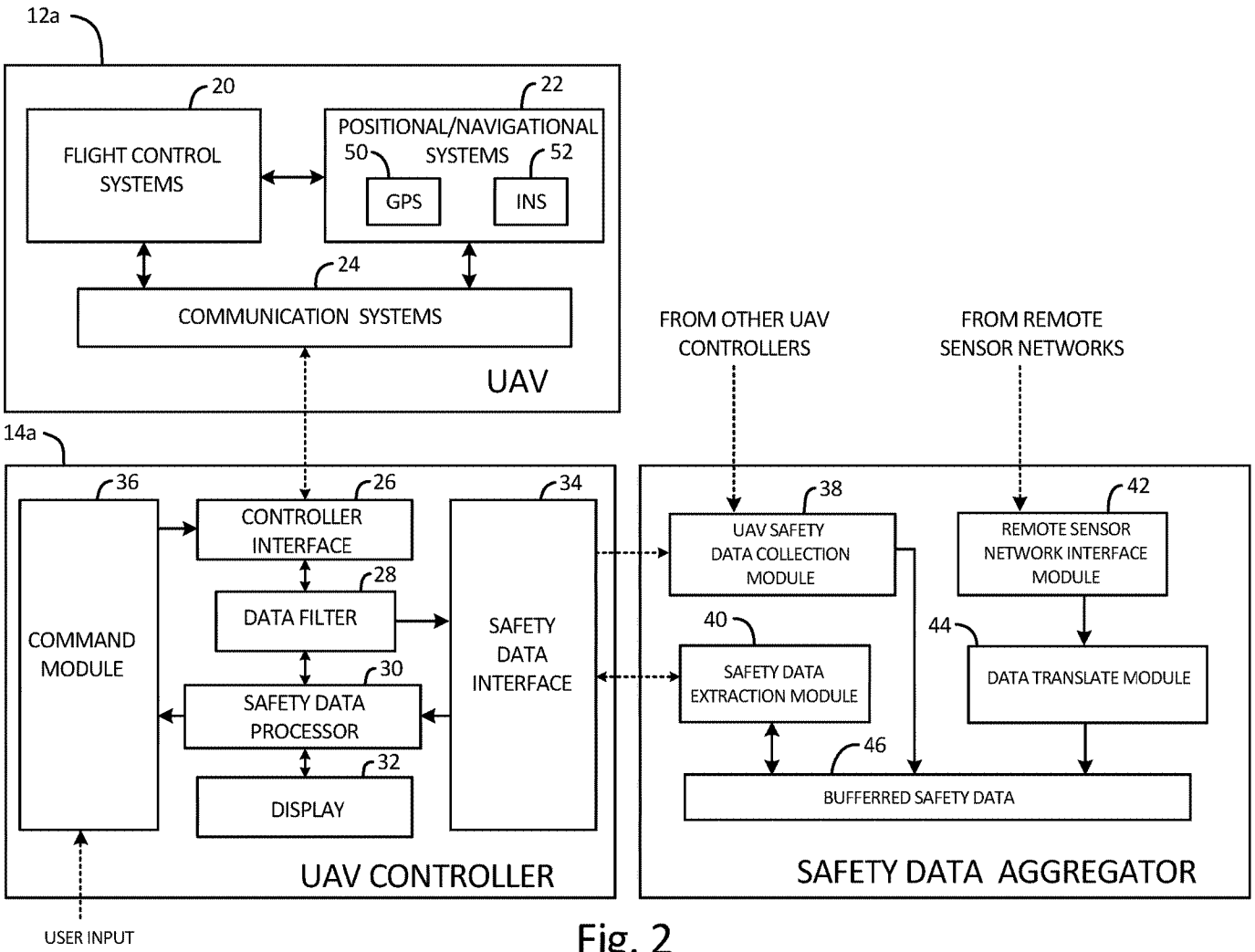
FIG. 2 is a block diagram that illustrates additional details of collision avoidance system according to an embodiment of the present invention.

As described in more detail with respect to FIG. 2, each UAV 12 is coupled to communicate bi-directionally with a respective UAV controller 14. UAV 12*a* communicates status information/feedback to UAV controller 14*a*, which includes safety data defined broadly to include at least positional data and may also include data related to heading (i.e., direction), speed, and/or orientation, as well as any other information related to the operation and flight of UAV 12. In turn, UAV controller 14*a* provides flight control information to UAV 12*a*, which may include specific instructions on controlling flight control surfaces, or may include more general instructions such as desired speed, heading, position, etc. of UAV 12*a*. Communication between UAV 12*a* and UAV controller 14*a* may be according to a variety of well-known communication means, including Wi-Fi, cellular, or other radio frequency means. In addition, data may be formatted for communication via according to a variety of well-known aviation standards, including MAVLINK, UAVLink, or other well-known standards.

UAV controller 14*a* is additionally coupled to communicate bi-directionally with safety data aggregator 16. In one embodiment, UAV controller 14*a* communicates via the Internet with safety data aggregator 16, although other communication means may be utilized. Data communicated from UAV controller 14*a* to safety system 16 may include any of the data collected from UAV 12*a*. However, in one embodiment the only data communicated from UAV controller 14*a* to safety system 16 is safety data related to one or more of position, speed, direction and orientation of UAV 12*a*. In addition, safety system 16 is coupled to communicate with third-party remote sensor networks 18, which are capable of detecting objects in three-dimensional space via one or more of radar installations, acoustic sensors, or LIDAR, or receivers capable of receiving radio transmissions from objects such as Automatic Dependent Surveillance Broadcast (ADS-B) receivers. Objects detected by third-party remote sensor networks 18 may include UAVs, although in many instances the size of UAVs makes them difficult to detect via third-party remote sensor networks. However, the information provided by third-party remote sensor networks 18 will typically include information on commercial aircraft traffic, etc. Safety data aggregator 16 may be connected directly to third-party remote sensor networks 18, or may be connected to an intermediate system that aggregates data from a plurality of third-party remote sensor networks.

Safety data collected from the plurality of UAV controllers 14, as well as safety data collected from third-party remote sensor networks 18 is aggregated by safety data aggregator 16 into a spatially organized database or buffer that provides real-time or near real-time safety data. Having collected safety data from both UAV controllers 14 and remote sensing networks 18, safety data aggregator makes this information available for use. In one embodiment, the aggregated safety data may be made available to other users or entities that could benefit from the additional information, such as traditional aircraft controllers. To provide spatially relevant data, safety data aggregator 16 extracts a sub-set of the aggregated safety data in response to requests from individual UAV controllers 14 and/or traditional aircraft controllers. The request includes position information of the UAV making the request and is utilized to extract spatially relevant data from geo-spatial database. UAV controller 14*a* receives the spatially relevant data and utilizes the received information to determine the risk of collision associated with UAV 12*a*. In one embodiment, if the risk of collision is great enough, UAV controller 14*a* generates a "safety point" command that directs UAV 12 to a determined safe location before returning control to the remote pilot. In other embodiments, various alerts and/or warnings may be generated and displayed or otherwise communicated to the UAV pilot, allowing the UAV pilot to manually avoid potential collisions.

A benefit of the present invention is that it does not require the presence of collision avoidance sensors (e.g., radar, LIDAR, etc.) onboard UAV 12. Rather, by aggregating position data received from each of the plurality of UAVs 12*a*, 12*b*, 12*c* in combination with information collected by third party remote sensor networks 18*a*, 18*b*, and 18*c*, a robust and cost-effective collision avoidance system may be provided.

FIG. 2 is a block diagram that illustrates additional details of collision avoidance system 10 according to an embodiment of the present invention. In the embodiment shown in FIG. 2, UAV 12*a* includes flight control systems 20, positional/navigational systems 22, and communications system 24. In addition, UAV controller 14*a* includes controller interface 26, data filter module 28, safety data processor 30, display 32, safety communication interface 34, and UAV command module 36. Safety data aggregator 16 includes UAV safety data collection module 38, safety data extraction module 40, remote sensor network interface module 42, data translator module 44, and geo-spatial safety data buffer 46.

In the embodiment shown in FIG. 2, UAV 12*a* is configured to monitor its position via positional/navigational system 22, which may utilize one or more of global positioning system (GPS) 50, inertial navigation system (INS) 52, other well-known positional sensors, and/or combinations thereof. As well understood, GPS system 50 utilizes signals received from three or more satellites to determine the three-dimensional location of the UAV 12*a*, which can be monitored over time to determine other safety data such as speed and direction of UAV 12*a*. INS 52 includes motion sensors (e.g., accelerometers) and rotational sensors (e.g., gyroscopes) to determine the orientation, speed, and velocity (direction and speed) of UAV 12*a*. These systems may be used in either alone or in conjunction with one another to generate safety data, which may include in addition to position of UAV 12*a*, the heading, speed, and/or orientation of UAV 12*a*.

In addition, positional/navigation system 22 may be utilized to provide flight commands to flight control systems 20. While in some embodiments flight control systems, such as engine speed and flight control surfaces, are controlled directly by a user via UAV controller 14*a*, in other embodiments the commands provided by a user are with respect to a desired position, orientation, or speed of UAV 12*a*. In these embodiments, commands received from UAV controller 14*a* via communication system 24 are provided to positional/navigation system 22, which compares the commands to current position, orientation, and/or speed of UAV 12*a* and in response generates commands provided to flight control systems 20. As described in more detail below, in one aspect of the present invention, in response to a detected collision alert UAV controller 14*a* will generate a "safe position" command that is provided to flight control systems 20 via communication system 24. The "safe position" command provides the coordinates calculated by UAV controller to prevent a collision. Based on the current position, orientation and direction of UAV 12*a*, positional/navigation system 22 generates commands provided to flight control systems 20 to control aspects such as engine speed and flight control surfaces. However, it should be understood that in other embodiments this functionality may be located as part of flight control systems 20.

Communication system 24 is responsible for providing bi-directional communication with UAV controller 14*a*. In one embodiment, communication system 24 utilizes Wi-Fi, a cellular modem, or other well-known radio-frequency communication standards. In the embodiment shown in FIG. 2, communication system 24 receives safety data from positional/navigation system 22, which as discussed above may include position, orientation, heading and/or speed of the aircraft. This information is aggregated with additional diagnostic information associated with UAV 12*a* and communicated by communications system 24 to UAV controller 14*a*. A variety of well-known communication protocols may be utilized, including the MAVLink communication protocol, UAVLink, or others. Communication system 24 may be programmed to communicate aggregated data to UAV controller 14*a* at regular intervals, or may be programmed to communicate in response to a request from UAV controller 14*a*.

In the embodiment shown in FIG. 2, UAV controller 14*a* is implemented on a hand-held device such as a tablet, laptop, or other mobile device capable of communicating wirelessly with UAV 12*a*. However, in other embodiments the software and hardware components utilized to implement UAV controller 14*a* may be embodied on a traditional desktop-type workstation or server. Controller interface 26 implemented within UAV controller 14*a* provides bi-directional communication between UAV 12*a* and UAV controller 14*a*. In one embodiment, controller interface 26 is configured to monitor communications received from UAV 12*a*, and provide a notification to data filter module 28 when new data is received from UAV 12*a*.

Data filter module 28, in response to a notification from controller interface 26 that new data has been received, determines whether the received data includes data relevant to collision avoidance (e.g., safety data). If relevant to collision avoidance, safety data—including position, speed, heading, and/or orientation—is extracted from the aggregated communication by data filter module 28 and provided to safety data interface 34 and safety data processor 30. Safety data provided to safety data interference is provided for the purposes of sharing the location of UAV 12 with safety data aggregator 16 such that the locations of a plurality of UAVs may be collected and shared. In addition, safety data is provided to safety data processor 30 to be compared with aggregated safety data received from safety data aggregator 16 regarding the location of spatially relevant aircraft—both UAV and piloted craft—such that collision avoidance algorithms may be utilized to detect and prevent potential collisions.

In one embodiment, safety data interface 34 communicates with remotely located safety data aggregator 16 via the Internet, although in other embodiments may communicate via other available communication channels. As described in more detail below, safety data aggregator 16 collects positional information received from UAV 12*a*, from other UAVs, and from remote sensor networks that monitor typical air traffic (e.g., commercial aircraft). The positional information collected from these sources is aggregated to create a geo-spatial database with more complete information regarding the position of both piloted and non-piloted (UAV) aircraft.

In addition to providing updated safety data related to UAV 12*a* to safety data aggregator 16, safety data interface 34 may also request aggregated safety data from safety data aggregator 16 regarding the presence of aircraft operating in approximately the same location or airspace as UAV 12*a*. The request includes position information associated with UAV 12*a*, which is utilized by safety data aggregator 16 to locate spatially relevant safety data. In one embodiment, the provision of updated safety data to safety data aggregator 16—which includes positional information—automatically triggers a request for aggregated safety data Aggregated safety data received from safety data aggregator 16 regarding aircraft operating in the vicinity of UAV 12*a* is provided to safety data processor 30 via safety data interface 34 for collision avoidance analysis. In addition to aggregated safety data, safety data processor 30 also receives updated safety data filtered by data filter 28. Ideally, the updated safety data received by safety data processor 30 is the same updated safety data utilized to request aggregated safety data from safety data aggregator 16. However, safety data processor 30 will utilize the most recently updated safety data and aggregated safety data in collision avoidance calculations. The level of collision avoidance possible is based, in part, on the amount of information provided. In some embodiments, position, heading, and/or speed information will be included in both the safety data related to UAV 12*a* and the aggregated safety data received from safety data aggregator 16. In other embodiments, only position information will be provided as part of either the safety data provided by UAV 12*a* or the aggregated safety data provided by safety data aggregator 16. Based on collected safety data, safety data processor 30 calculates collision avoidance geometries. In one embodiment, safety data processor interacts with display 32 to visually illustrate the position of nearby aircraft derived from aggregated safety data. In another embodiment, safety data processor may additionally generate alarms or alert indicating via display 32 the likelihood of a collision, and may suggest to the user a course of action to avoid a collision. In another embodiment, if determined that the likelihood of collision is high enough, safety data processor 30 may generate a "safety point" command. In this embodiment, the safety point command has the effect of overriding commands provided by the remote pilot, and automatically directing UAV 12*a* to a safe location as calculated by safety data processor 30 to avoid a collision. During normal operations, command module 36 receives commands from a user via an input device that it translates and provides to controller interface 26 for provision to UAV 12*a*.

In the embodiment shown in FIG. 2, safety data aggregator 16 is located remotely from UAV controller 14*a*. As discussed above, bi-directional communication between safety data aggregator 16 and UAV controller 14*a* may be according to a variety of well-known communication standards (e.g., Internet). Safety data aggregator may be implemented with a combination of hardware and software including one or more computers, servers, etc.

UAV safety data collection module 38 collects safety data provided by UAV controller 14*a*, as well as safety data made available by any number of other UAV controllers. As discussed above, safety data includes, at the very least, position information associated with the UAV, and may in addition include information regarding orientation, hearing, and/or speed of the associated UAV. In addition, safety data may include identifying information that identifies either the UAV controller or UAV with which it is associated. Safety data received by UAV safety data collection module 38—from a plurality of UAV controllers—is stored to safety data buffer or database 46.

In addition to data received from the plurality of UAV controllers, safety data aggregator 16 also collects safety data from remote sensor networks 18. In the embodiment shown in FIG. 2, remote sensor network interface module 42 communicates with and collects safety data from remote sensor networks 18. Updates from remote sensor networks 18 may be received periodically according to a predetermined schedule, or may be in response to a request from remote sensor network interface module 42. In one embodiment, requests from remote sensor network interface module 42 are controlled by a timer that is started when safety data aggregator begins operations. The time interval between requests may be programmed to any desired value, but in one embodiment is set to approximately two seconds. Data translator 44 translates safety data received from remote sensor network interface module 42 to the same or similar form as that received from UAV controllers 14.

Received safety data—both from UAV controllers 14 and remote sensor networks 18—are stored to safety data buffer 46. Buffered safety data may be stored temporarily in a transient medium, such as random access memory, or may be stored to a persistent memory device such as flash memory or hard disk drive. Due to the fact that stored safety data loses value the longer it has been stored, in one embodiment safety data associated with a particular aircraft may only need to be stored for a short amount of time before deleted or re-written with new data. However, in some embodiments it may be desirable or useful to store safety for longer periods of time for purposes of analyzing the performance of collision avoidance system 10. In addition, in one embodiment safety data buffer 46 is organized spatially to allow spatially relevant data to be extracted from safety data buffer 46. That is, safety data stored to safety data buffer 46 is organized and/or searchable based on position to allow spatially relevant data to be searched and returned to a user.

In the embodiment shown in FIG. 2, safety data extractor module 40 extracts spatially relevant safety data from safety data buffer 46 and provides the extracted safety data to safety data interface 34. In one embodiment, safety data extractor module 40 extracts spatially relevant safety data in response to a request from safety data interface 34. In another embodiment, safety data extraction module 40 automatically extracts spatially relevant safety data in response to updated safety data received from the respective UAV controller 14*a*. Updated safety data from UAV 12*a* indicates that the position of the UAV has changed, and therefore should be provided with an updated snapshot of spatially relevant safety data based on the new location.

In this way, collision avoidance system 10 provides a system of aggregating safety data (e.g., position, orientation, speed, direction) associated with UAVs—collected from one or more UAV controllers—as well as other aircraft monitored via traditional remote sensor networks. Spatially relevant excerpts or slices of aggregated safety data can then be extracted and provided to the UAV controllers, which use the aggregated data to provide collision avoidance. As a result, individual UAVs may operate safely without requiring onboard collision avoidance sensors and/or collision avoidance processors.

Figure 3A:
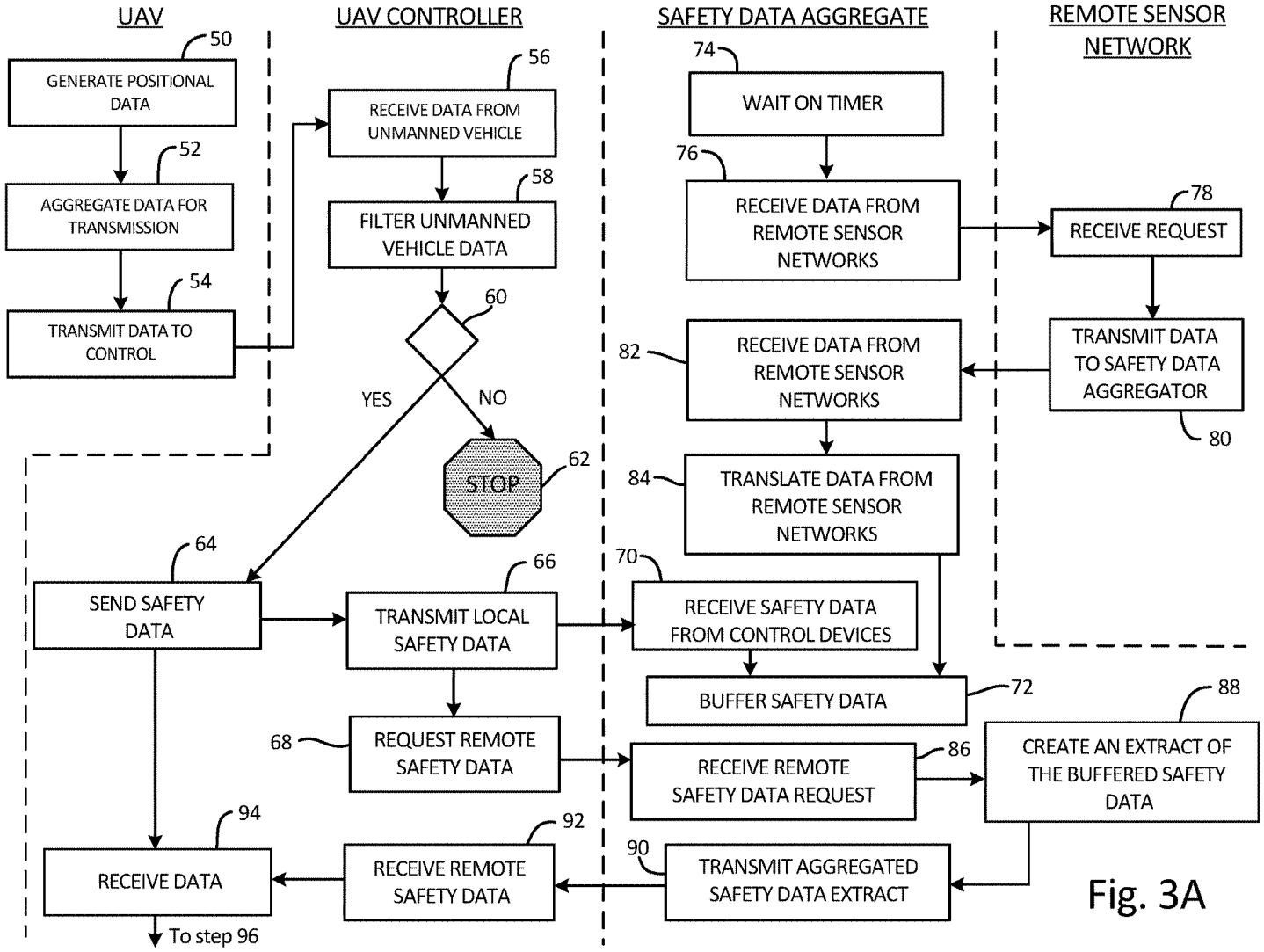
FIGS. 3*a* and 3*b* are directed to a flowchart that illustrates steps performed by collision avoidance system according to an embodiment of the present invention.
Figure 3B:
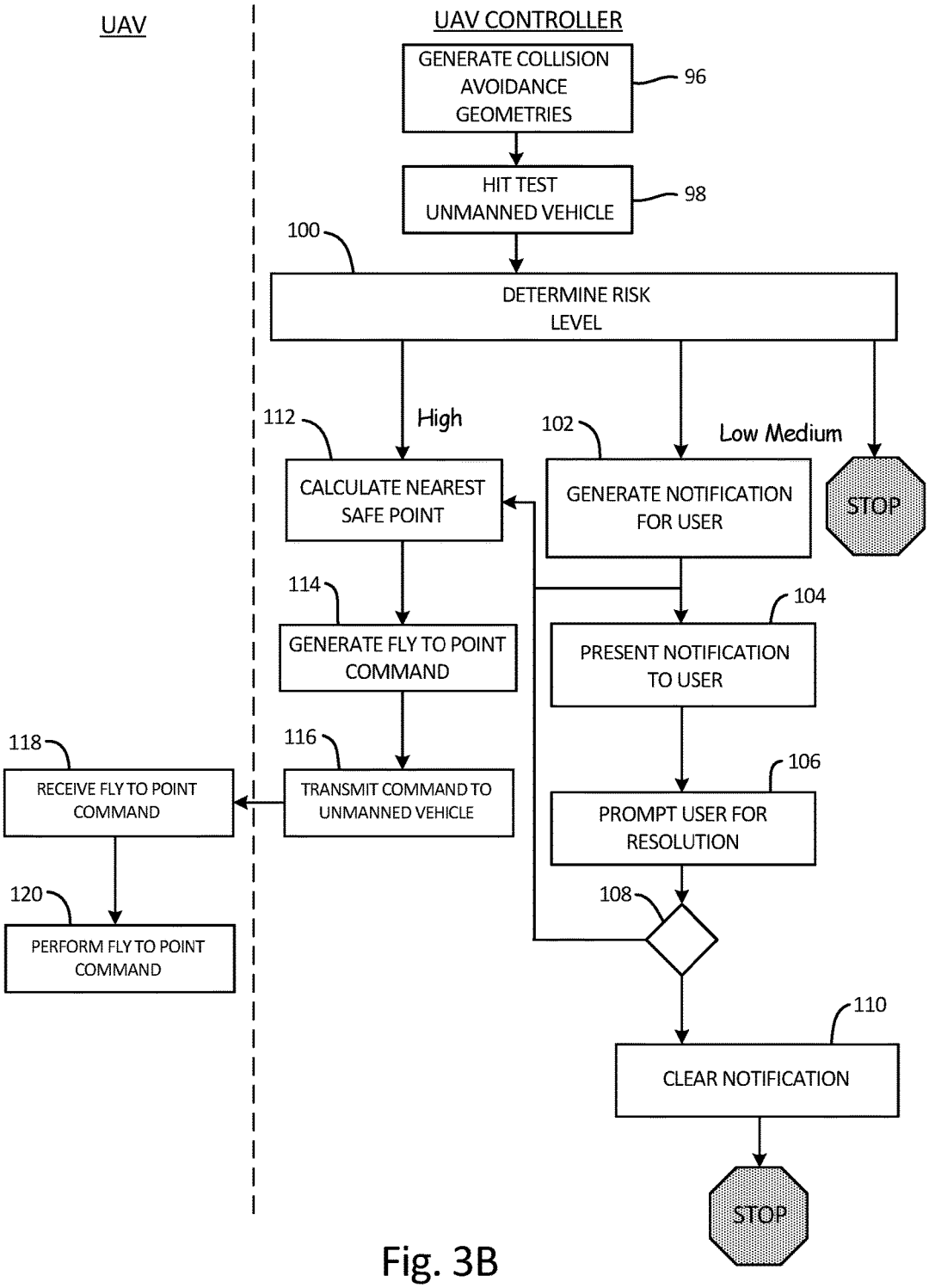

FIGS. 3*a* and 3*b* make up a flowchart that illustrates steps performed by collision avoidance system according to an embodiment of the present invention. In particular, FIGS. 3*a* and 3*b* include headers that indicate the component/device (shown in FIG. 2) responsible for performing the steps provided in the column listed beneath the header. It should be understood that indication of the component/device responsible for performing the steps is exemplary, and in other embodiments one or more of the steps may be performed by another one of the devices. For example a calculation performed remotely by the safety data aggregator may in other embodiments be performed locally by the UAV controller. In addition, while the plurality of steps are numbered, it should be understood that the numbered steps do not imply an order in which the steps are required to be performed, and in fact many are implemented simultaneously.

At step 50, positional/safety data associated with UAV 12 is generated. As described above, positional/safety information may be generated via one or more on-board sensors (e.g., GPS, INS, etc.), and may be generated periodically.

At step 52, positional/safety data is aggregated with other on-board data for transmission from UAV 12 to UAV controller 14. In one embodiment, positional/safety data is aggregated with other on-board data only when it provides an update to a previous position.

At step 54, aggregated data is transmitted from UAV 12*a* to UAV controller 14*a* via a wireless communication link. As described above, any one of a variety of well-known wireless communication standards may be employed (e.g., cellular, etc). Transmission from UAV 12*a* to UAV controller 14*a* may be initiated periodically or on demand from UAV controller 14*a*. In one embodiment, UAV 12*a* is configured to provide periodic updates at an interval not to exceed 300 milliseconds.

At step 56, aggregated data is received by UAV controller 14*a* via controller interface 26 (shown in FIG. 2). At step 58, aggregated data is filtered to identify safety data. As described above, in some embodiments safety data may also include data related to direction and/or speed of UAV 12*a*. At step 58, a determination is made whether the aggregated data included data relevant to deconfliction. In some embodiments, aggregated data communicated from UAV 12*a* to UAV controller 14*a* will not always include safety data. This may result from GPS sensor 50 providing updates at a longer interval than other updates included in the aggregated data. If at step 58 it is determined that the aggregated data does not include data relevant to deconfliction (e.g., does not include updated safety data), then no further action is taken on this data as indicated by stop 62. If at step 58 it is determined that the aggregated data does include data related to deconfliction (e.g., does include safety data), then at step 64 data related to safety—which includes positional information, and may additionally include speed and/or header information—is sent. Communication of safety data at step 64 is bifurcated such that safety data is simultaneously communicated to safety data interface 34 for communication to remote safety data aggregator 16, as well as to safety data processor 30 (as shown in FIG. 2). As indicated by the dataflow subsequent to step 64, operations will be executed in tandem, with some operations being performed remotely at safety data aggregator 16 and some operations performed locally at UAV controller 14*a*. Operations performed remotely at safety data aggregator 16 are discussed first, although it should be noted that this does not imply that these operations are executed prior to those discussed subsequently.

At step 66, local safety data provided to safety data interface 34 is communicated to safety data aggregator 16. In the embodiment shown in FIG. 2, the communicated local safety data is received by UAV safety data collection module 38, along with local safety data provided by a plurality of other UAV controllers. In one embodiment, local safety data further includes identification uniquely identifying the UAV to which the local safety data is related. At step 68, in addition to communicating local safety data, safety data interface 34 also communicates a request to safety data aggregator 16 for aggregated safety data that is spatially relevant to UAV 12*a*. In one embodiment, the request for spatially relevant safety data is made separate from the provision of local safety data to safety data aggregator 16. In other embodiments, the provision of local safety at step 66 automatically initiates a request for spatially relevant safety data.

For the sake of simplicity, the chain of events resulting from the transmission of local safety data at step 66 is discussed prior to discussing the chain of events resulting from the transmission of the request for spatially relevant safety data. At step 70, safety data aggregator 16 receives the local safety data transmitted by UAV controller 14*a*. At step 72, the received local safety data—along with local safety data received from other UAV controllers—is stored to a memory buffer such as safety data buffer 46 shown in FIG. 2. As discussed above, the memory buffer may utilize one or more storage mediums, such as random access memory, flash memory, hard disk drives, etc. In addition, safety data stored to safety data buffer 46 is organized geo-spatially, allowing data to be retrieved from safety data buffer 46 based on proximity to a specified location, as discussed in more detail below with respect to extracting safety data for return to UAV controller 14*a*.

In addition to local safety data provided by individual UAV controllers, safety data provided by remote sensor networks 18 are also stored to safety data buffer 46. Steps 74-84 illustrate the collection of safety data from remote sensor networks 18.

At step 74, the expiration of a timer maintained by safety data aggregator 16 indicates that a request should be made to remote sensor network 18 for updated remote safety data. The timer is reset, such that requests are made to remote sensor network 18 at regular intervals. At step 76, in response to the expired timer, a request is generated by safety data aggregator 16 and provided to remote sensor network 18. At step 78, the request is received by remote sensor network 18, which responds with collected remote safety data at step 80. As discussed above, remote sensor network 18 may include a network of sensors capable of detecting objects in three dimensional space, including radar installations, acoustic sensors, LIDAR, and receivers capable of processing positional information from ADS-B transmitters. At step 82, remote safety data provided by remote sensor network 18 is received by safety data aggregator 16. At step 84, the received remote safety data is translated into the same format as local safety data received from the individual UAV controllers 14. At step 84, the translated safety data from remote sensor networks 18 is stored to safety data buffer 46. In this way, safety data buffer 46 includes both data received from individual UAV controllers, as well as data received by traditional remote sensing networks. As a result, safety data buffer 46 provides more complete knowledge of safety data than is currently available. In addition, because safety data buffer is organized spatially, it allows the buffer to be searched to locate safety data relevant to a particular location.

Having provided local safety data to safety data aggregator 16 to be aggregated and stored, UAV controller 14*a* may make a request for spatially relevant safety data from safety data aggregator 16. In the embodiment shown in FIG. 3, at step 66 when local safety data is transmitted to safety data aggregator 16, a request is also made at step 68 for safety data spatially relevant to the local safety data provided. At step 86, this request is received by safety data aggregator 16. At step 88, safety data aggregator 16 utilizes the position provided as part of the request to extract spatially relevant safety data (hereinafter, aggregated safety data) from safety data buffer 46. In one embodiment, safety data within a predetermined radius or distance (e.g., geofence) of the position provided in the request is extracted.

At step 90, aggregated safety data is communicated from safety data aggregator 16 to UAV controller 14*a*. At step 92, aggregated safety data is received at UAV controller 14*a*. In response to received aggregated safety data, a notification is generated alerting safety processor 30 of the newly acquired safety data, and making the safety data available to safety processor 30.

At step 94, safety processor 30 receives aggregated safety data provided by safety data aggregator 16 and local safety data provided by UAV 12. In addition, safety processor 30 may include local storage that allows safety data to be buffered or stored for a period of time, with safety processor 30 utilizing the most recent safety data as part of the collision analysis. At step 96, safety processor 30 utilizes local safety data received from UAV 12 and aggregated safety data received from safety data aggregator 16 to make a determination regarding the likelihood of collision. As discussed elsewhere, safety data may include a variety of information related to UAV and non-UAV aircraft, such as position, heading, and speed. In addition, both local and aggregated safety data may include timestamps indicating the time the safety data was captured. Based on the acquired safety data, safety processor calculates geometries representing the possible location of each object identified. For example, in one embodiment multiple geometries representing possible locations of all objects identified in the aggregated safety data are calculated. In one embodiment, the resulting geometry may be described as a three-dimensional cone extending away from the present location of the identified object, with volume of the cone growing larger the farther removed from the present location. The direction in which the cone extends may be based on direction and speed information associated with the object, or may be based on positional information received at multiple points in time (i.e., different timestamps). In other embodiments, several different geometries are calculated for each object.

At step 98, the position of UAV 12*a* is then tested against the calculated geometries, wherein instances in which the position of the UAV is located within a calculated geometry is indicative of a potential collision. In another embodiment, rather than test the position of UAV 12*a* against the calculated geometries, a geometry of possible future positions is calculated for UAV 12*a*, wherein the intersection between the geometry calculated for UAV 12*a* and geometries calculated for other objects is indicative of a potential collision. Those objects identified as posing potential collision threats are saved for subsequent analysis. Having calculated a set of possible collisions, each element of the set of possible collisions is examined to determine a probability of collision and determine possible safe locations for UAV 12*a*.

At step 100, a determination is made regarding the probability risk of a collision. In the embodiment shown in FIG. 3, a tiered system of collision probabilities is provided, each with a different response. For example, if no probability of collision exists, then the process ends as indicated by the stop signal. If a small or medium risk of collision is indicated by the collision geometries, then a notification is generated at step 102, and displayed to the user at step 104. The display may be in the form of a visual and/or audio alert, and may display graphically the location of the object posing a potential collision threat relative to the location of the UAV. In the embodiment shown in FIG. 3, at step 106 the user is further prompted for resolution, and at step 108 is able to provide input indicating that the collision alert should be ignored (thereby clearing the notification at step 110) or initiating a collision avoidance response at step 112. In the embodiment shown in FIG. 3, low and medium level collision alerts may be selectively ignored by the user. However, in this embodiment, if the collision alert is determined at step 100 to be a high-level alert, then the user is not prompted for input regarding whether the alert should be ignored. Rather, at step 112 the safety processor calculates based on the collision geometries a nearest "safe point", which is a position that removes the UAV from the collision geometries of nearby objects. In this embodiment, at step 114 the calculated safe point is provided to command module 36, which generates in response commands to be provided to UAV 12 to direct the UAV to the desired safe location. At step 116, the commands are communicated to UAV 12. At step 118, the commands are received at UAV 12, and at step 120 the commands are utilized to direct UAV 12 to the desired safe point.

In this way, the present invention provides a system and method of aggregating data related to the position of UAVs and making that data available in a way that prevents collisions between UAVs and other aircraft. In particular, the collection of positional data from the plurality of UAVs allows for the collection of data not previously available via traditional remote sensing networks (e.g., radar, LIDAR, etc). In addition, the provision of this data to UAV controllers, calculation of possible collision geometries, and automatic collision avoidance provides a solution to the problem of how to allow people to operate UAVs safely while preventing collisions with other piloted aircraft.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A collision avoidance system comprising:

an unmanned aerial vehicle (UAV) that includes a positional sensor;

a UAV controller coupled to communicate wirelessly with the UAV, wherein the UAV controller receives safety data from the UAV and provides command instructions to control operation of the UAV, wherein the safety data includes positional data associated with the UAV; and a safety data aggregator coupled to communicate with the UAV controller, wherein the safety data aggregator collects safety data from one or more UAV controllers, stores collected safety data in a safety data buffer, and extracts spatially relevant safety data in response to a request from the UAV controller; and wherein the UAV controller determines a risk of collision based on calculating geometries representing possible locations of objects identified in the spatially relevant safety data and the safety data provided by the UAV, wherein calculated geometries are represented as three-dimensional cones extending from a present location of each identified object in a direction determined from the received safety data associated with each identified object.

2. The collision avoidance system of claim 1, wherein the request from the UAV controller for spatially relevant safety data includes the positional data provided by the UAV, wherein spatially relevant positional data is selected based, at least in part, on the positional data included in the request.

3. The collision avoidance system of claim 2, wherein the UAV controller utilizes the spatially relevant positional data provided by the safety data aggregator to determine a risk of collision associated with the UAV, wherein the spatially relevant positional data provided by the safety data aggregator provides information regarding the presence of aircraft operating in a vicinity of the UAV.

4. The collision avoidance system of claim 3, wherein the UAV controller generates a safety point command that directs the UAV to a safe location in response to a determined risk of collision based, at least in part, on the spatially relevant positional data provided by the safety data aggregator and the positional data provided by the UAV.

5. The collision avoidance system of claim 3, wherein the UAV further includes an inertial navigation system that collects orientation, speed, and/or velocity data associated with the UAV, wherein the safety data provided to the UAV controller includes the collected orientation, speed, and/or velocity data and is utilized by the UAV controller to determine the risk of collision associated with the UAV.

6. The collision avoidance system of claim 1, wherein the UAV controller further includes a safety data interface that is configured to communicate the safety data received from the UAV to the safety data aggregator for inclusion, at least in part, in the safety data buffer, wherein the safety data aggregator is remotely located from the UAV controller.

7. The collision avoidance system of claim 6, wherein the UAV controller further includes a safety data processor that receives safety data from the UAV and spatially relevant safety data received from the safety data aggregator, wherein the safety data processor compares safety data associated with the UAV with the spatially relevant safety data received from the safety data aggregator to determine a risk of collision with nearby aircraft.

8. The collision avoidance system of claim 7, wherein the safety data processor calculates collision avoidance geometries based, at least in part, on the safety data associated with the UAV and the spatially relevant safety data received from the safety data aggregator.

9. The collision avoidance system of claim 1, wherein the safety data aggregator further includes a remote sensor network interface module coupled to receive safety data measured by a remote sensor network, wherein safety data received from the remote sensor network is stored to the safety data buffer and made available for extraction by the safety data aggregator.

10. A method of aggregating and distributing safety data, the method comprising:

collecting safety data from a plurality of unmanned aerial vehicles, including positional data associated with each of the plurality of unmanned aerial vehicles;

providing the collected safety data to a safety data aggregator;

storing the collected safety data in a geo-spatial database that is searchable to provide spatially relevant positional/safety data;

receiving a request from a UAV controller for spatially relevant safety data, wherein the request includes positional data of the UAV associated with the requesting UAV controller;

extracting spatially relevant safety data from the geo-spatial database based on the positional data provided in the request from the UAV controller; and providing the spatially relevant safety data to the UAV controller for collision avoidance analysis; and determining a risk of collision based on calculating geometries representing possible locations of objects identified in the spatially relevant safety data and the safety data collected by the plurality of unmanned aerial vehicles, wherein calculated geometries are represented as three-dimensional cones extending from a present location of each identified object in a direction determined from the received safety data associated with each identified object.

11. The method of claim 10, further including collecting safety data from one or more remote sensor networks capable of detecting objects in three dimensional space, wherein the safety data collected from the one or more remote sensor networks is provided to the safety data aggregator for storage in the geo-spatial database.

12. The method of claim 11, wherein the remote sensor networks comprises at least one of a radar installation, acoustic sensor, LIDAR, and receivers capable of processing positional information from ADS-B transmitters.

13. The method of claim 10, wherein extracting spatially relevant safety data from the geo-spatial database based on the positional data provided by the UAV controller includes extracting safety data within a predetermined radius or distance of the position provided in the request from the UAV controller.

14. A method of providing collision avoidance, the method comprising:

receiving at an unmanned aerial vehicle (UAV) controller safety data provided by a UAV, wherein the safety data includes positional data related to the position of the UAV;

communicating the received safety data to a remotely located safety data aggregator;

receiving spatially relevant safety data from the safety data aggregator based on positional data provided to the safety data aggregator; and determining a risk of collision based on a comparison of safety data received from the UAV and spatially relevant safety data received from the safety data aggregator; and wherein determining a risk of collision includes calculating geometries representing possible locations of objects identified in the spatially relevant safety data and the safety data provided by the UAV, wherein calculated geometries are represented as three-dimensional cones extending from a present location of each identified object in a direction determined from the received safety data associated with each identified object.

15. The method of claim 14, wherein the safety data provided by the UAV includes one or more of directional data, orientation data, speed data, and positional data.

16. The method of claim 14, wherein based on the interaction of the calculated geometries for identified objects, a collision risk is assigned to the UAV.

17. The method of claim 16, wherein in response to a detected high collision risk level, the method includes calculating a safe location for the UAV and communicating instructions to the UAV to direct the UAV to the calculated safe location.

18. The method of claim 16, wherein in response to a detected low collision risk level, the method includes displaying a notification via the UAV controller of the detected risk and graphically displaying a location of the object posing a potential collision threat.

19. A safety data aggregator system comprising:

an unmanned aerial vehicle (UAV) data collection module coupled to receive safety data from one or more UAV controllers, wherein safety data includes at least position data of UAVs controlled by the one or more UAV controllers;

a remote sensor network interface module coupled to receive safety data measured by a remote sensor network;

a safety data buffer configured to store safety data received by the UAV data collection module and remote sensor network interface module; and a safety data extraction module that receives requests for spatially relevant safety data, wherein the safety data extraction module interacts with the safety data buffer to extract spatially relevant safety data, wherein the spatially relevant safety data is communicated to the UAV controller for which the extracted data is spatially relevant; and wherein the UAV controller determines a risk of collision based on calculating geometries representing possible locations of objects identified in the spatially relevant safety data and the safety data, wherein calculated geometries are represented as three-dimensional cones extending from a present location of each identified object in a direction determined from the received safety data associated with each identified object.

20. The safety data aggregator system of claim 19, wherein the safety data received from the UAV controllers includes one or more of position data, orientation data, directional data, and speed data.

21. The safety data aggregator system of claim 19, further including a data translation module coupled with the remote sensor network interface, wherein the data translation module translates received safety data in a format that can be stored by the geo-spatial database.

22. The safety data aggregator system of claim 19, wherein the safety data buffer is a geo-spatial database that is searchable by relevance to a provided position or location.

* * * * *